US007830354B2

(12) United States Patent
Kim

(10) Patent No.: US 7,830,354 B2
(45) Date of Patent: Nov. 9, 2010

(54) DRIVING APPARATUS FOR DISPLAY DEVICE THAT USES CONTROL SIGNALS BASED ON SUM OF CLOCK SIGNALS

(75) Inventor: Ah-Reum Kim, Seoul (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 879 days.

(21) Appl. No.: 11/701,207

(22) Filed: Jan. 31, 2007

(65) Prior Publication Data

US 2007/0195055 A1 Aug. 23, 2007

(30) Foreign Application Priority Data

Feb. 2, 2006 (KR) ..... 10-2006-0010076

(51) Int. Cl.
*G09G 3/36* (2006.01)

(52) U.S. Cl. ..... 345/100; 345/213

(58) Field of Classification Search ..... 345/87, 345/100

See application file for complete search history.

(56) References Cited

U.S. PATENT DOCUMENTS

2002/0140364 A1* 10/2002 Inukai ..... 315/169.3
2004/0150610 A1* 8/2004 Zebedee et al. ..... 345/100
2006/0227095 A1* 10/2006 Kim et al. ..... 345/100
2008/0122774 A1* 5/2008 Jo et al. ..... 345/94
2010/0060619 A1* 3/2010 Kim et al. ..... 345/205

* cited by examiner

*Primary Examiner*—Richard Hjerpe
*Assistant Examiner*—Andrew Schnirel
(74) *Attorney, Agent, or Firm*—Innovation Counsel LLP

(57) ABSTRACT

A driving apparatus for a display device that is capable of lowering the manufacturing cost for different types of gate driving integrated circuits is presented. The apparatus has pixels arranged in a matrix, each pixel having a first and a second subpixels. A gate driver has a plurality of gate driving circuits, and each of the plurality of gate driving circuits generates first and second gate signals that are applied to the first and second subpixels, respectively. A controller outputs control signals for controlling the output of a carry signal for each of the gate driving circuits. Where an OR gate serves as the controller, two types of gate signals for different pixel rows can be generated: a first type where gate signals are applied to the different pixel rows at the same time and a second type where gate signals are not applied at the same time.

21 Claims, 8 Drawing Sheets

DRIVING APPARATUS FOR DISPLAY DEVICE THAT USES CONTROL SIGNALS BASED ON SUM OF CLOCK SIGNALS

CROSS-REFERENCE TO RELATED APPLICATION

This application claims priority to the benefit of Korean Patent Application No. 10-2006-0010076 filed in the Korean Intellectual Property Office on Feb. 2, 2006, the entire content of which is incorporated herein by reference.

BACKGROUND OF THE INVENTION (a) Field of the Invention

The present invention relates to a driving apparatus for a display device and a display device having the same.

(b) Description of the Related Art

Today, liquid crystal displays are one of the more widely used types of flat panel displays. A liquid crystal display has two display panels on which field generating electrodes, such as pixel electrodes and a common electrode, are formed and a liquid crystal layer that is interposed between the panels. In the liquid crystal display, a voltage is applied to the field generating electrodes to generate an electric field, and the alignment of liquid crystal molecules of the liquid crystal layer is determined by the electric field. Accordingly, the polarization of incident light is controlled, thereby displaying the desired image.

Meanwhile, the liquid crystal display includes display panels on which pixels (which include switching elements and display signal lines) are provided and a gate driver that transmits gate signals to gate lines among the display signal lines to turn on/off the switching elements of the pixels.

The gate driver is typically an integrated circuit (IC) type, and includes a shift register, a level shifter, and an output buffer. The shift register includes a plurality of stages that are connected to one another. Each stage sequentially generates an output, and the generated output is applied to the gate line through the level shifter and the output buffer.

A method has been suggested in which one pixel is divided into two subpixels that are capacitively coupled to each other. In this case, a voltage is directly applied to one subpixel, and a voltage drop occurs in the other subpixel by the capacitive coupling. Then the voltage varies between the two subpixels, and thus transmittance varies between the two subpixels.

The gate signals that are generated by the existing gate driver are broadly classified into two types of gate signals: gate signals that overlap to simultaneously turn on two subpixels in the same pixel row but do not overlap in different pixel rows, and gate signals that overlap in different pixel rows. However, there is no gate driver that can generate the two types of signals and thus gate drivers need to be separately manufactured for the two types of signals.

BRIEF SUMMARY OF THE INVENTION

The present invention has been made in an effort to provide a driving apparatus for a display device and a display device having the same, having advantages of generating two types of gate signals.

In one aspect, the invention is a driving apparatus having a plurality of pixels arranged in a matrix wherein each of the plurality of pixels has a first and a second subpixel. The driving apparatus includes a gate driver and a controller. The gate driver has a plurality of gate driving circuits, wherein each of the plurality of gate driving circuits generates first and second gate signals and respectively applies the first and second gate signals to the first and second subpixels. The controller outputs control signals for controlling the output of a carry signal for each of the plurality of gate driving circuits.

The controller may be a logic circuit, such as an OR gate. In this case, each of the plurality of gate driving circuits and the OR gate may receive first and second clock signals each having high and low levels.

Control signals may include first and second signals each having first and second states, and each of the plurality of gate driving circuits may output the carry signal in synchronization with a falling edge of the last signal among the second gate signals when the first signal is input and may output the carry signal in synchronization with a falling edge of the last signal among the first gate signals when the second signal is input.

At this time, the first state may include both high and low values, and the second state may include only the high value. Further, the first gate signal may be output earlier than the second gate signal.

The first and second gate signals which are applied to different pixel rows may not overlap each other. In this case, each of the plurality of gate driving circuits may output the carry signal in synchronization with a falling edge of the last signal among the second gate signals according to control signals of the controller. The first gate signal may be output earlier than the second gate signal. Further, the controller may include an OR gate.

The first and second gate signals for different pixel rows may overlap each other. In this case, each of the plurality of gate driving circuits may output the carry signal in synchronization with a falling edge of the last signal among the first gate signals according to control signals of the controller. The first gate signal may be output earlier than the second gate signal. Further, the controller may include an OR circuit.

In another aspect, the invention is a display device that includes a plurality of pixels that are arranged in a matrix configuration, each of the plurality of pixels having first and second subpixels. A plurality of first gate lines is connected to the first subpixels and transmits first gate signals, and a plurality of second gate lines is connected to the second subpixels and transmits second gate signals. A gate driver has a plurality of gate driving circuits, each of the plurality of gate driving circuits generating the first and second gate signals. A controller outputs control signals for controlling the output of a carry signal for each of the plurality of gate driving circuits.

The controller may include an OR gate.

Each of the plurality of gate driving circuits and the OR gate may receive first and second clock signals having high and low levels.

Control signals may include first and second signals each having first and second states, and each of the plurality of gate driving circuits may output the carry signal in synchronization with a falling edge of the last signal among the second gate signals when the first signal is input or may output the carry signal in synchronization with a falling edge of the last signal among the first gate signals when the second signal is input.

The first state may include both high and low values, and the second state may include only the high value. Further, the first gate signal may be output earlier than the second gate signal.

The display device may be a liquid crystal display.

BRIEF DESCRIPTION OF THE DRAWINGS

The accompanying drawings, briefly described below, illustrate exemplary embodiments of the present invention and, together with the description, serve to explain the principles of the present invention.

DETAILED DESCRIPTION OF THE INVENTION

The present invention will be described more fully hereinafter with reference to the accompanying drawings, in which preferred embodiments of the invention are shown. As those skilled in the art would realize, the described embodiments may be modified in various different ways, all without departing from the spirit or scope of the present invention.

Figure 1:
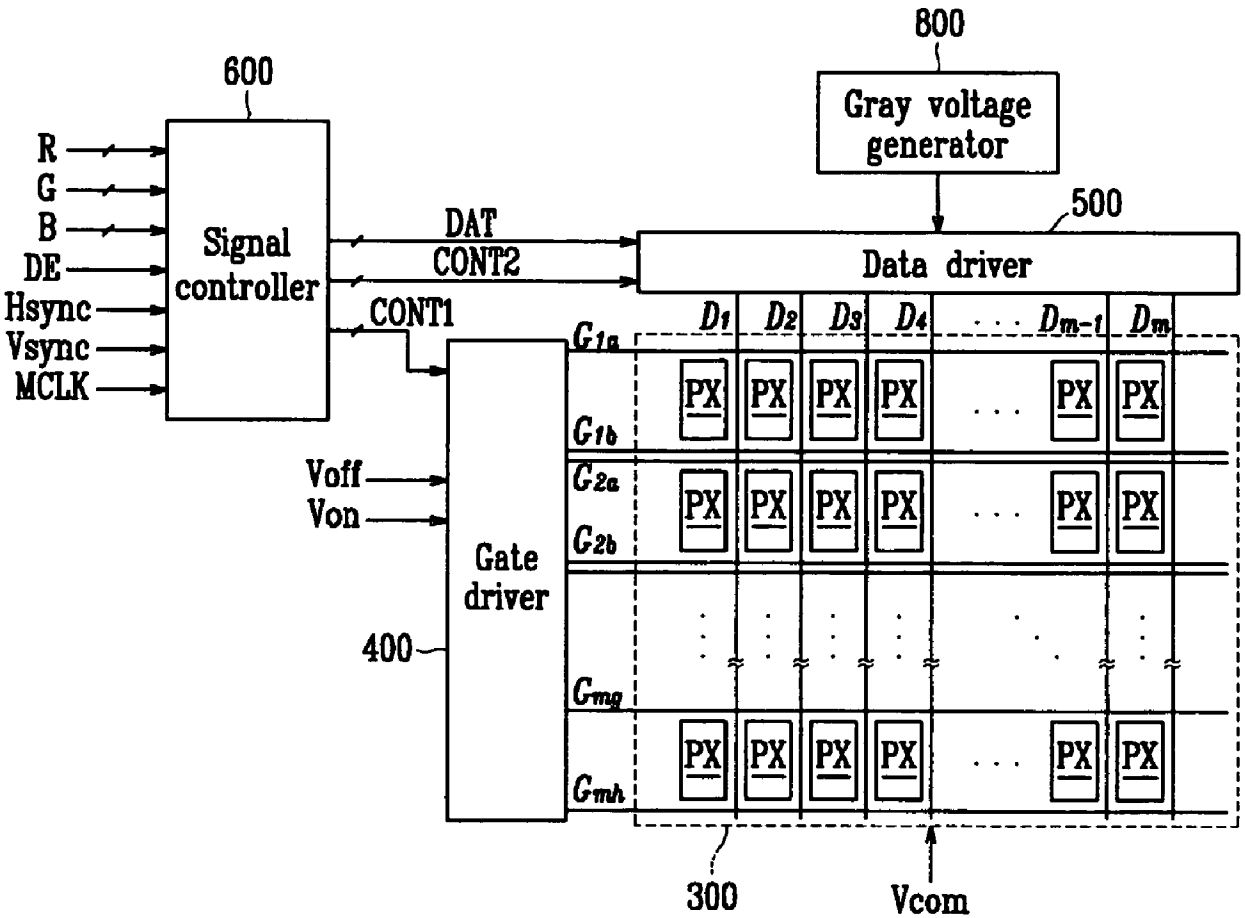
FIG. 1 is a block diagram of a liquid crystal display according to an exemplary embodiment of the present invention.
Figure 2A:
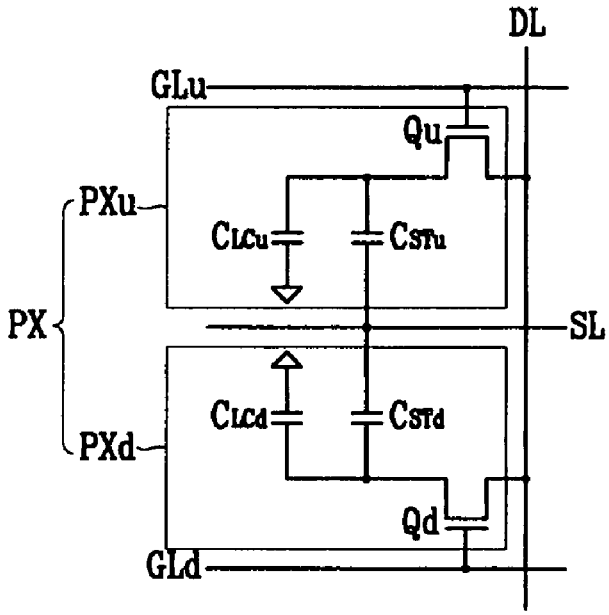
FIG. 2A and FIG. 2B are equivalent circuit diagrams of one pixel in a liquid crystal display according to an exemplary embodiment of the present invention.
Figure 2B:
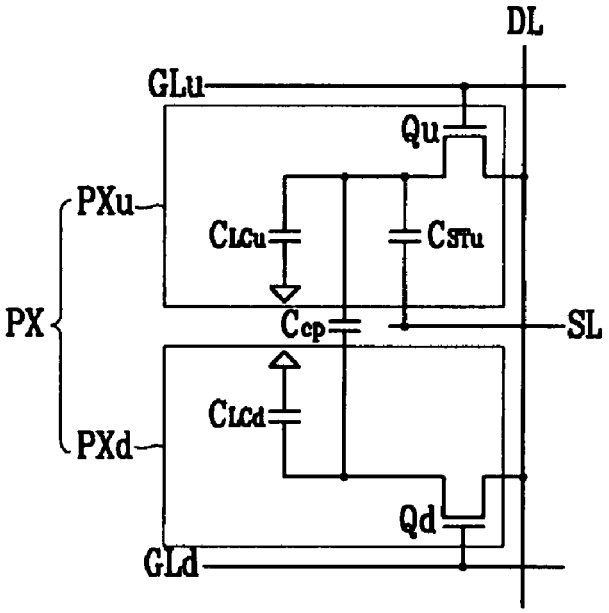
Figure 3:
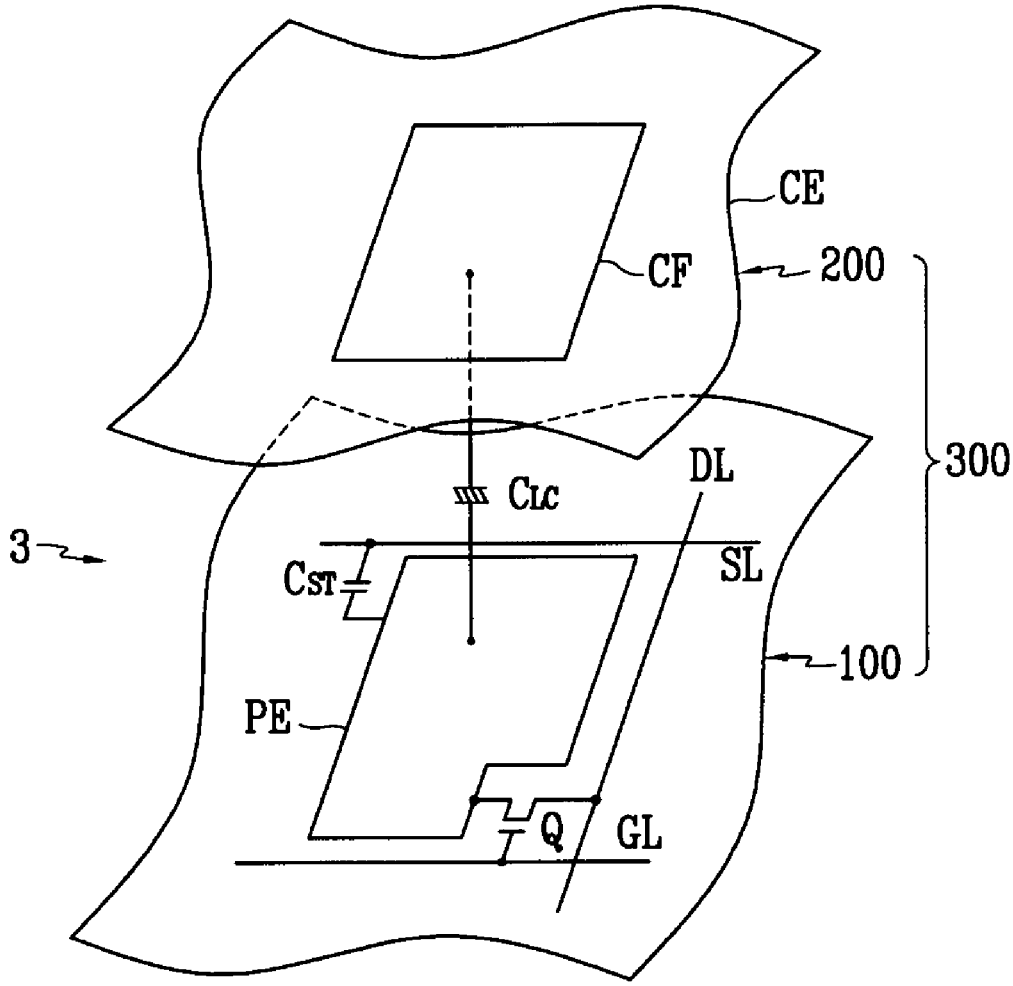
FIG. 3 is an equivalent circuit diagram of one pixel in a liquid crystal display according to an exemplary embodiment of the present invention.

FIG. 1 is a block diagram of a liquid crystal display according to an exemplary embodiment of the present invention, FIG. 2A and FIG. 2B are equivalent circuit diagrams of one pixel in a liquid crystal display according to an exemplary embodiment of the present invention, and FIG. 3 is an equivalent circuit diagram of one pixel in a liquid crystal display according to an exemplary embodiment of the present invention.

Referring to FIG. 1, a liquid crystal display according to an exemplary embodiment of the present invention includes a liquid crystal panel assembly 300, a gate driver 400 and a data driver 500 that are connected to the liquid crystal panel assembly 300, a gray voltage generator 800 that is connected to the data driver 500, and a signal controller 600 that controls these parts.

In an equivalent circuit, the liquid crystal panel assembly 300 includes a plurality of display signal lines, and a plurality of pixels PX that is connected to the display signal lines and is substantially arranged in a matrix configuration. Meanwhile, in a structure shown in FIG. 3, the liquid crystal panel assembly 300 includes lower and upper panels 100 and 200 that faces each other, and a liquid crystal layer 3 that is interposed between the panels 100 and 200.

The display signal lines are provided on the lower panel 100 and include a plurality of gate lines $G_{1a}$ to $G_{mh}$ that transmits gate signals (also referred to as "scanning signals") and a plurality of data lines $D_1$ to $D_m$ that transmits data signals. The gate lines $G_{1a}$ to $G_m$ substantially extend in a first direction parallel to one another and the data lines $D_1$ to $D_m$ substantially extend in a second direction parallel to one another.

FIG. 2A and FIG. 2B show the display signal lines and an equivalent circuit of a pixel. In addition to the gate lines represented by reference numerals GLu and GLd and the data lines represented by reference numeral DL, the display signal lines include storage electrode lines SL that extend substantially parallel to the gate lines $G_{Lu}$ to $G_{Ld}$.

Referring to FIG. 2A, each pixel PX includes a pair of subpixels PXu and PXd that are arranged next to each other. The subpixels PXu and PXd respectively include switching elements Qu and Qd connected to the gate lines GLu and GLd and the data line DL, liquid crystal capacitors $C_{LC}$u and $C_{LC}$d connected to the switching elements Qu and Qd, and storage capacitors $C_{ST}$u and $C_{ST}$d connected to the switching elements Qu and Qd and the storage electrode lines SL. If necessary, the storage capacitors $C_{ST}$u and $C_{ST}$d can be omitted.

Referring to FIG. 2B, each pixel PX includes a pair of subpixels PXu and PXd and a coupling capacitor Ccp connected to the subpixels PXu and PXd. The subpixels PXu and PXd respectively include the switching elements Qu and Qd connected to the gate lines GLu and GLd and the data line DL and the liquid crystal capacitors $C_{LC}$u and $C_{LC}$d connected to the switching elements. One subpixel PXu of the two subpixels PXu and PXd includes the switching element Qu, and the storage capacitor $C_{ST}$u connected to the storage electrode line SL.

Referring to FIG. 3, the switching element Qof each of the subpixels PXu and PXd is a thin film transistor provided on the lower panel 100 or the like. The thin film transistor is a three-terminal element having a control terminal connected to the gate line GL, an input terminal connected to the data line DL, and an output terminal connected to the liquid crystal capacitor $C_{LC}$ and the storage capacitor $C_{ST}$.

The liquid crystal capacitor $C_{LC}$ has two terminals: a first terminal for a subpixel electrode PE on the lower panel 100 and a second terminal for a common electrode CE on the upper panel 200. The liquid crystal layer 3 between the two electrodes PE and CE serves as a dielectric material. The subpixel electrode PE is connected to the switching element Q and the common electrode CE is formed on the entire surface of the upper panel 200. A common voltage Vcom is applied to the common electrode CE. In another embodiment, the common electrode CE may be provided on the lower panel 100. In this case, at least one of the two electrodes PE and CE can be formed in a linear or a bar shape.

The storage capacitor $C_{ST}$, which assists the liquid crystal capacitor $C_{LC}$, has the storage electrode line SL and the subpixel electrode PE provided on the lower panel 100 and is separated by an insulator. A fixed voltage such as the common voltage Vcom is applied to the storage electrode line SL. In another embodiment, the storage capacitor $C_{ST}$ of the other subpixel(not shown)may be formed by the subpixel electrode PE and the previous gate line that overlaps the subpixel electrode PE with an insulator between them.

Meanwhile, for color display, each pixel uniquely displays one of the primary colors (spatial division) or each pixel alternately displays the three primary colors (temporal division) as time lapses, and a desired color is recognized by a spatial and temporal sum of the three primary colors. The three primary colors may be, for example, red, green, and blue. The embodiment shown in FIG. 3 uses spatial division where each pixel has a color filter CF for one of the primary colors in a region of the upper panel 200. Unlike FIG. 3, the color filter CF may be formed above or below the subpixel electrode PE of the lower panel 100.

Referring to FIG. 1, the gate driver 400 is connected to the gate lines $G_{1a}$ to $G_{mh}$, and applies the gate signals, which are combinations of a gate-on voltage Von and a gate-off voltage Voff from the outside to the gate lines $G_{1a}$ to $G_{mh}$.

The gray voltage generator 800 generates two sets of gray voltages related to transmittance of the pixel (or a set of reference gray voltages). The two sets of gray voltages are independently supplied to the two subpixels constituting one pixel. Each set of gray voltages includes gray voltages having positive and negative values with respect to the common voltage Vcom, respectively. However, instead of the two sets of (reference) gray voltages, only one set of (reference) gray voltages may be generated.

The data driver 500 is connected to the data lines $D_1$ to $D_m$ of the liquid crystal panel assembly 300. The data driver 500 selects one of the two sets of gray voltages from the gray voltage generator 800, and applies one gray voltage from the selected set of gray voltages to the pixel as a data voltage. However, when the gray voltage generator 800 supplies the reference gray voltage instead of voltages for all gray levels, the data driver 500 divides the reference gray voltage to generate the gray voltages for all gray levels and selects the data voltage from among these.

The gate driver 400 or the data driver 500 may be directly mounted on the liquid crystal panel assembly 300 in the form of a plurality of driving IC chips or may be attached to the liquid crystal panel assembly 300 while being mounted on a flexible printed circuit film (not shown) by a TCP (tape carrier package). Alternately, the gate driver 400 or the data driver 500 may be integrated into the liquid crystal panel assembly 300, together with the display signal lines $G_{1a}$ to $G_{mh}$ and $D_1$ to $D_m$ and the thin film transistor switching elements Qu and Qd.

The signal controller 600 controls the operations of the gate driver 400, the data driver 500, and so on.

The display operation of the liquid crystal display will now be described in detail.

The signal controller 600 receives input image signals R, G, and B and input control signals for controlling the display of the input image signals R, G, and B, such as a vertical synchronization signal, Vsync, a horizontal synchronization signal Hsync, a main clock MCLK, a data enable signal DE, and so on from an external graphic controller (not shown). The signal controller 600 processes the image signals R, G, and B according to the operating condition of the liquid crystal panel assembly 300 on the basis of the input image signals R, G, and B and the input control signals, and generates a gate control signal CONT1 and a data control signal CONT2. Then, the signal controller 600 supplies the gate control signal CONT1 to the gate driver 400 and supplies the data control signal CONT2 and the processed image signal DAT to the data driver 500.

The gate control signal CONT1 includes a scanning start signal STV that instructs to start scanning and a plurality of gate clock signals CPV1 and CPV2 for controlling an output time of a gate-on voltage Von.

The data control signal CONT2 includes a horizontal synchronization start signal STH that notifies transmission of data to a set of pixels PX, a load signal LOAD instructing to apply the data voltage to the data lines $D_1$ to $D_m$, and a data clock signal HCLK. The data control signal CONT2 may also include an inversion signal RVS for inverting the polarity of the data voltage relative to the common voltage Vcom (hereinafter, the polarity of the data voltage relative to the common voltage is simply referred to as the polarity of the data voltage).

On the basis of the data control signal CONT2 from the signal controller 600, the data driver 500 receives image data DAT for a set of subpixels PXu and PXd, selects one of the two sets of gray voltages from the gray voltage generator 800, and selects the gray voltage corresponding to the image data DAT from the selected set of gray voltages. Then, the data driver 500 converts the image data DAT into the corresponding data voltage, and applies the data voltage to the data lines $D_1$ to $D_m$.

The gate driver 400 applies the gate-on voltage Von to the gate lines $G_{1a}$ to $G_{mh}$ on the basis of the gate control signal CONT1 from the signal controller 600 to turn on switching elements Qu and Qd connected to the gate lines $G_{1a}$ to $G_{mh}$. Accordingly, the data voltage applied to the data lines $D_1$ to $D_m$ is applied to the subpixels PXu and PXd through the turned-on switching elements Qu and Qd.

The difference between the data voltage applied to the subpixels PXu and PXd and the common voltage Vcom becomes the charge voltage of the liquid crystal capacitor $C_{LC}$, that is, a pixel voltage. The alignment of liquid crystal molecules varies according to the value of the pixel voltage, and the polarization of light passing through the liquid crystal layer 3 changes with the liquid crystal molecule alignment. Thus, the change in polarization of the light affects light transmission through the polarizers (not shown) attached to the display panels 100 and 200.

The data driver 500 and the gate driver 400 repeat the same operations for every one horizontal period (or "1H"), which refers to one cycle of the horizontal synchronization signal Hsync and the gate clock signal CPV. In such a manner, the gate-on voltage Von is applied to all of the gate lines $G_{1a}$ to $G_{mh}$ for one frame and the data voltage is applied to all of the pixels. Upon completing one frame and starting a next frame, the state of the inversion signal RVS to be applied to the data driver 500 is controlled such that the polarity of the data voltage to be applied to each pixel is opposite to the polarity in the previous frame ("frame inversion"). The polarities of the data voltage on one data line may be changed in one frame according to the characteristics of the inversion signal RVS (for example, row inversion or dot inversion) or the polarities of the data voltage on adjacent data lines may be different from each other (for example, column inversion or dot inversion).

The gate driver of the liquid crystal display according to an exemplary embodiment of the present invention will now be described in detail with reference to FIG. 4A to FIG. 7E.

Figure 4A:
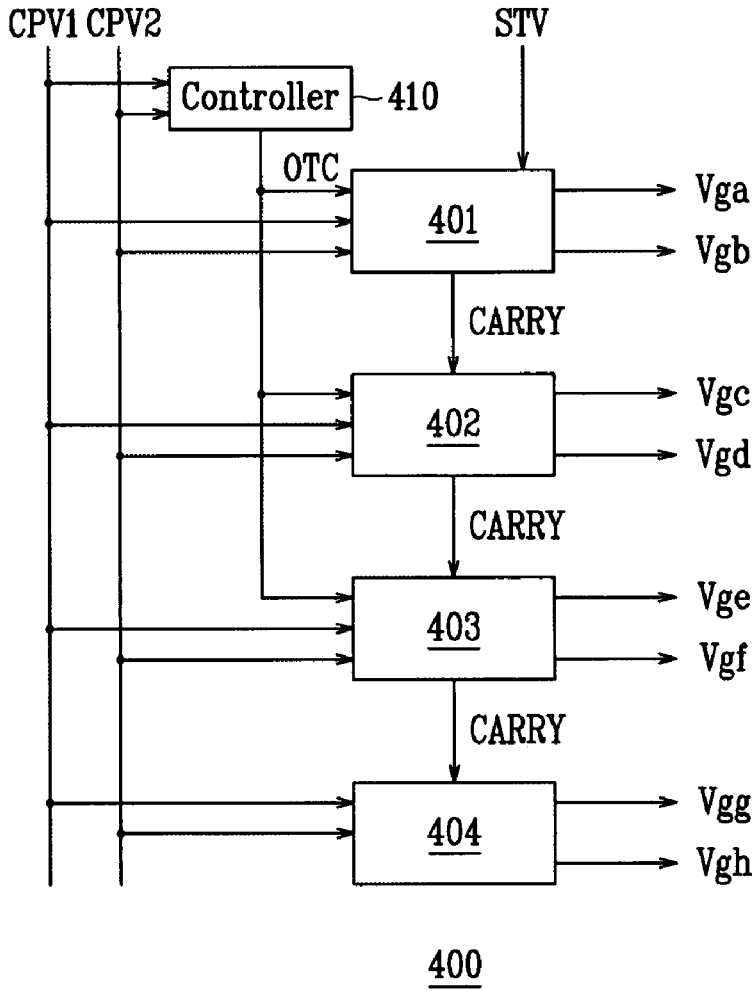
FIG. 4A is a block diagram of a gate driver according to an exemplary embodiment of the present invention.
Figure 4B:
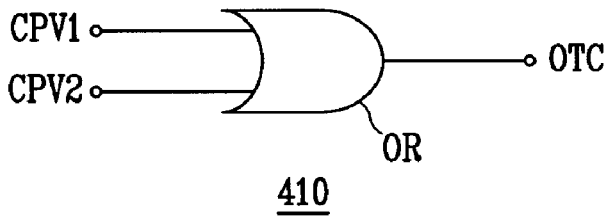
FIG. 4B is an example of a circuit diagram of the controller shown in FIG. 4A.
Figure 5:
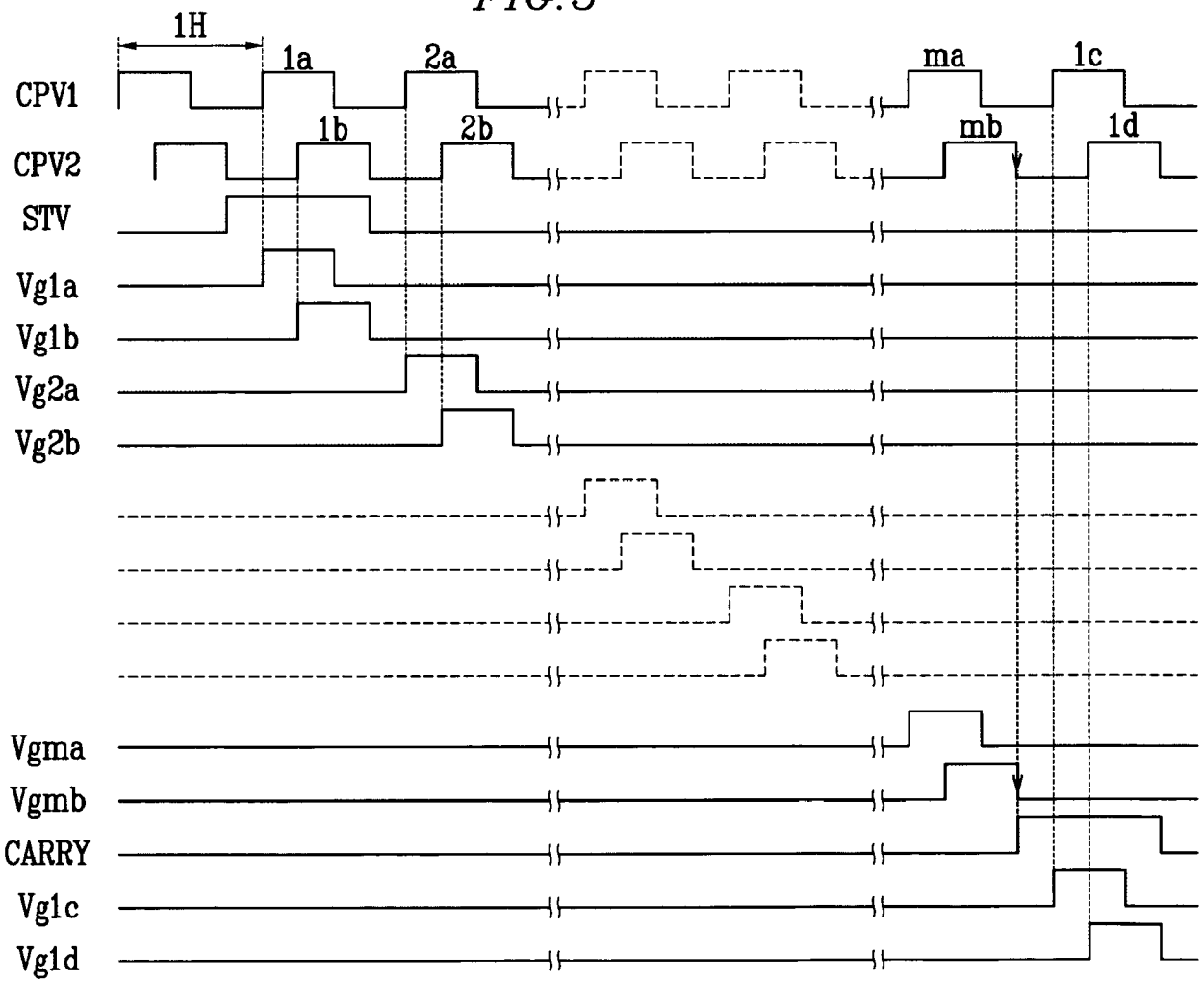
FIG. 5 is an example of a timing chart of the gate driver shown in FIG. 4A.
Figure 6:
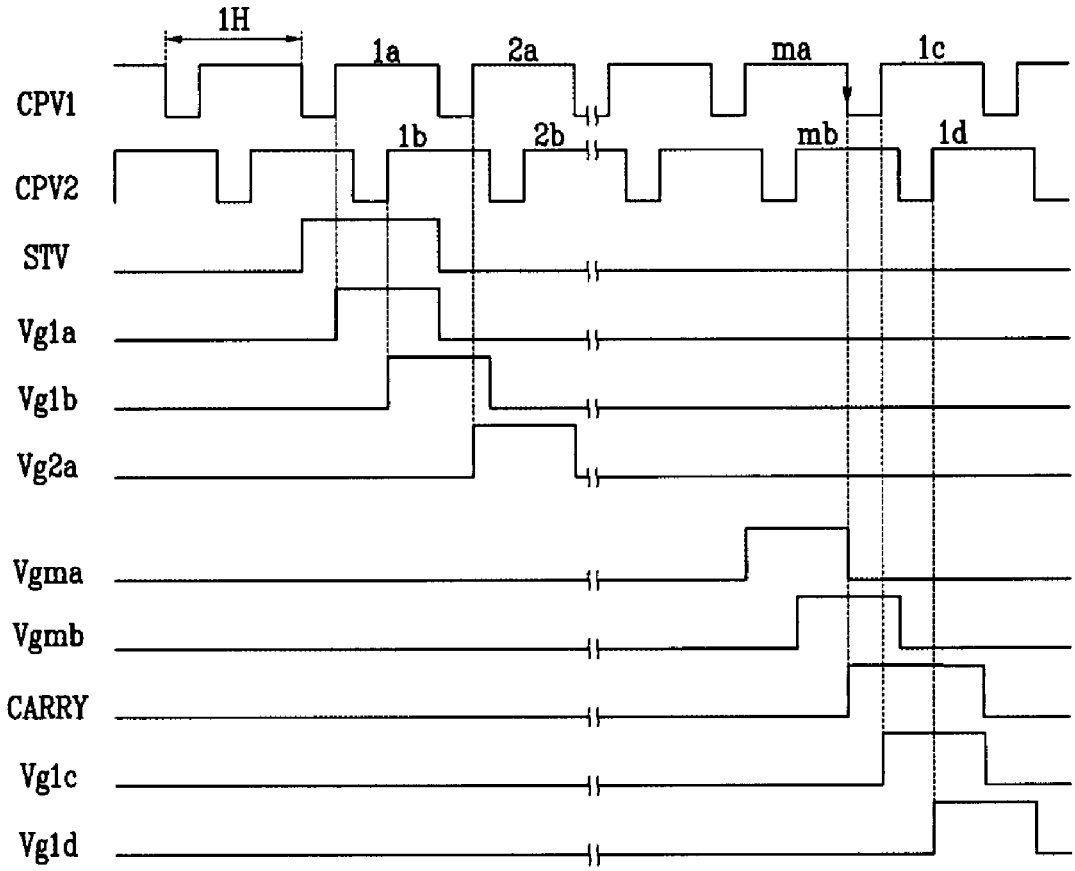
FIG. 6 is another example of a timing chart of the gate driver shown in FIG. 4A.
Figure 7A:
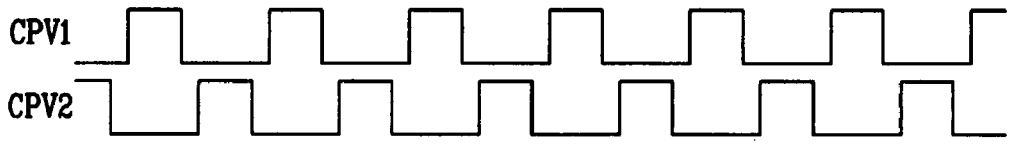
FIG. 7A to FIG. 7E are examples of a gate clock signal according to an exemplary embodiment of the present invention.
Figure 7B:
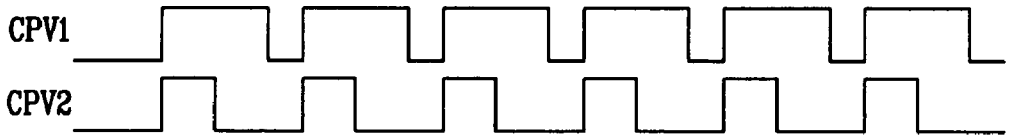
Figure 7C:
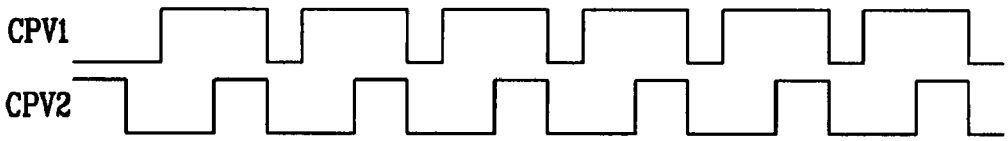
Figure 7D:
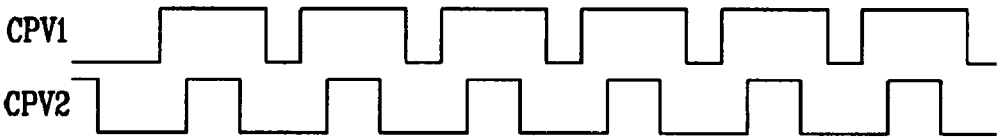
Figure 7E:
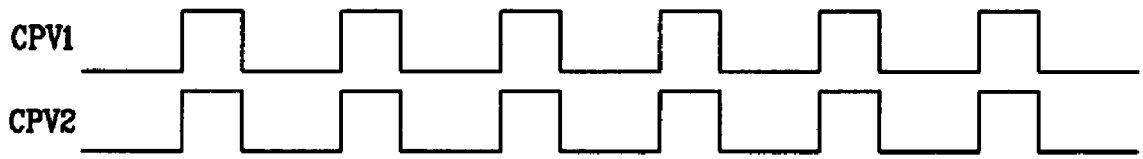

FIG. 4A is a block diagram of a gate driver according to an exemplary embodiment of the present invention, and FIG. 4B is an example of a circuit diagram of a controller 410 shown in FIG. 4A. FIG. 5 is an example of a timing chart of the gate driver shown in FIG. 4. FIG. 6 is another example of a timing chart of the gate driver shown in FIG. 4. FIG. 7A to FIG. 7E are various examples of a gate clock signal according to an exemplary embodiment of the present invention.

Referring to FIG. 4A and FIG. 4B, the gate driver 400 according to the exemplary embodiment of the present invention includes a plurality of gate driving integrated circuits (IC) 401 to 404 connected to one another and a controller 410.

In the exemplary embodiment of the present invention, for example, four gate driving integrated circuits (IC) 401 to 404 are used. The number of gate driving integrated circuits (IC) may be changed appropriately.

Each of the gate driving integrated circuits (IC) 401 to 404 receives a pair of gate clock signals CPV1 and CPV2. The first gate driving integrated circuit (IC) 401 receives the scanning start signal STV, and each of the second to fourth gate driving integrated circuits (IC) 402 to 404 receives the carry signal CARRY instead of the scanning start signal STV. That is, the first gate driving integrated circuit (IC) 401 operates depending on the scanning start signal STV and the second to fourth gate driving integrated circuits (IC) 402 to 404 operate depending on the carry signal CARRY.

The controller 410 supplies an output time control signal OTC for controlling an output time of the carry signal CARRY of each of the first to third gate driving integrated circuits (IC) 401 to 403 on the basis of the two gate clock signals CPV1 and CPV2.

The gate driving integrated circuits (IC) 401 to 404 are individually connected to m pixel rows, and supply gate outputs Vga, Vgb, Vgc, Vgd, Vge, Vgf, Vgg and Vgh, respectively. Here, Vgxy represents Vgx and Vgy. The gate outputs Vga, Vgb, Vgc, Vgd, Vge, Vgf, Vgg and Vgh are outputs to be applied to the gate lines GLu and GLd shown in FIG. 2A and FIG. 2B. Hereinafter, the gate line GLu is referred to as an odd-numbered gate line and the gate line GLd is referred to as an even-numbered gate line. Further, Vga, Vgc, Vge, and Vgg are referred to as odd-numbered gate signals and Vgb, Vgd, Vgf, and Vgh are referred to as even-numbered gate signals.

The first gate driving integrated circuit (IC) 401 receives the scanning start signal STV and supplies the outputs Vga, Vgb in synchronization with the two gate clock signals CPV1 and CPV2. The second to fourth gate driving integrated circuits (IC) 402 to 404 receive the carry signal CARRY from the previous gate driving integrated circuits (IC) 401 to 403 and generate the outputs Vgc, Vgd, Vge, Vgf, Vgg and Vgh in synchronization with the gate clock signals CPV1 and CPV2.

The time at which the output carry signal CARRY is generated varies, as in FIG. 5 and FIG. 6. This will now be described in detail. Here, only the operation of the first gate driving integrated circuit (IC) 401 will be illustrated. The operations of the remaining gate driving integrated circuits (IC) 402, 403, and 404 are substantially the same as the operation of the first gate driving integrated circuit (IC) 401, and thus their descriptions will be omitted.

First, the gate clock signals CPV1 and CPV2 shown in FIG. 5 have a duty ratio of about 50%, and the gate clock signal CPV1 is earlier than the gate clock signal CPV2 by about 1H/4. Further, the gate clock signals CPV1 and CPV2 shown in FIG. 6 have a duty ratio of about 75%, and the gate clock signal CPV1 is earlier than the gate clock signal CPV2 by about 1H/2

Accordingly, while the gate outputs to the two subpixels PXu and PXd may overlap each other, the gate outputs to different pixel rows are not overlap each other in the embodiment of FIG. 5. In the embodiment of FIG. 6, however, the gate outputs to different pixel rows overlaps each other.

Referring to FIG. 5, the output carry signal CARRY to be generated by the first gate driving integrated circuit (IC) 401 is generated in synchronization with a falling edge of the last even-numbered gate output Vgmb. Meanwhile, the output carry signal CARRY shown in FIG. 6 is generated in synchronization with a falling edge of the last odd-numbered gate output Vgma.

At this time, as shown in FIG. 4B, the controller 410 has an OR gate and supplies the control signal OTC for controlling the output time of the carry signal CARRY.

That is, the two gate clock signals CPV1 and CPV2 are digital signals each having high and low levels. A logical sum of the two gate clock signals CPV1 and CPV2 shown in FIG. 5 has high and low values, while a logical sum of the two gate clock signals CPV1 and CPV2 shown in FIG. 6 has only the high value. Accordingly, when both the high and low values are input for a predetermined time, for example, 1H or 2H, the gate driving integrated circuits (IC) 401 to 403 generate the output carry signal CARRY according to the last even-numbered gate output Vgmb. Meanwhile, when only the high value is input, the gate driving integrated circuits (IC) 401 to 403 generate the output carry signal CARRY according to the last odd-numbered gate output Vgma.

In such a manner, the logical sum of the two gate clock signals CPV1 and CPV2 inevitably corresponds to one of the two cases described above, thereby generating the control signal, regardless of the duty ratio of the gate clock signals CPV1 and CPV2 or the like. FIG. 7A to FIG. 7E show various types of gate clock signals, which are examples of the gate clock signals CPV1 and CPV2 all outputting the high value and the low value. Therefore, each of the first to third gate driving integrated circuits (IC) 401 to 403 generates the output carry signal CARRY in synchronization with the falling edge of the last even-numbered gate output Vgmb.

Although the controller 410 is included in the gate driver 400 in the exemplary embodiment of the present invention, the controller 410 and the gate driver 400 may have separate circuits.

As such, with the OR gate serving as the controller 410, two types of gate signals to be applied to different pixel rows—i.e., gate signals that do not overlap each other and gate signals that overlap each other—can be generated. Therefore, cost of manufacturing different types of driving integrated circuits (IC) can be reduced.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A driving apparatus for a display device, which has a plurality of pixels arranged in a matrix, each of the plurality of pixels having first and second subpixels, the driving apparatus comprising:

a gate driver that comprises a plurality of gate driving circuits, each of the plurality of gate driving circuits generating first and second gate signals and applying the first and second gate signals to the first and second subpixels, respectively; and a controller that outputs control signals for controlling an output of a carry signal for each of the plurality of gate driving circuits, wherein the control signals are logical sums of first and second clock signals.

2. The driving apparatus for a display device of claim 1, wherein the controller comprises a logic circuit.

3. The driving apparatus for a display device of claim 2, wherein each of the plurality of gate driving circuits and an OR gate of the logic circuit receives the first and second clock signals having high and low levels.

4. The driving apparatus for a display device of claim 3, wherein:

the control signals include first or second signals each having first and second states; and each of the plurality of gate driving circuits outputs the carry signal in synchronization with a falling edge of the last signal among the second gate signals when the first signal is input, or outputs the carry signal in synchronization with a falling edge of the last signal among the first gate signals when the second signal is input.

5. The driving apparatus for a display device of claim 4, wherein the first state includes both high and low values, and the second state includes only high value.

6. The driving apparatus for a display device of claim 4, wherein the first gate signal is output earlier than the second gate signal.

7. The driving apparatus for a display device of claim 1, wherein the first gate signal is output earlier than the second gate signal.

8. The driving apparatus for a display device of claim 7, wherein each of the plurality of gate driving circuits outputs the carry signal in synchronization with a falling edge of the last signal among the second gate signals according to control signals of the controller.

9. The driving apparatus for a display device of claim 8, wherein the first and second gate signals for different pixel rows do not overlap each other.

10. The driving apparatus for a display device of claim 9, wherein the controller comprises an OR gate.

11. The driving apparatus for a display device of claim 1, wherein each of the plurality of gate driving circuits outputs the carry signal in synchronization with a falling edge of the last signal among the first gate signals according to the control signals of the controller.

12. The driving apparatus for a display device of claim 11, wherein the first and second gate signals for different pixel rows overlap each other.

13. The driving apparatus for a display device of claim 12, wherein the first gate signal is output earlier than the second gate signal.

14. The driving apparatus for a display device of claim 13, wherein the controller comprises an OR gate.

15. A display device, comprising:

a plurality of pixels that are arranged in a matrix, each of the plurality of pixels having first and second subpixels;

a plurality of first gate lines that are connected to the first subpixels and transmit first gate signals;

a plurality of second gate lines that are connected to the second subpixels and transmit second gate signals;

a gate driver that has a plurality of gate driving circuits, each of the plurality of gate driving circuits generating the first and second gate signals; and a controller that outputs control signals for controlling output of a carry signal for each of the plurality of gate driving circuits, wherein the control signals are logical sums of first and second clock signals.

16. The display device of claim 15, wherein the controller comprises an OR gate.

17. The display device of claim 16, wherein each of the plurality of gate driving circuits and the OR gate receives the first and second clock signals having high and low levels.

18. The display device of claim 17, wherein:

the control signals include first and second signals each having first and second states; and each of the plurality of gate driving circuits outputs the carry signal in synchronization with a falling edge of the last signal among the second gate signals when the first signal is input, or outputs the carry signal in synchronization with a falling edge of the last signal among the first gate signals when the second signal is input.

19. The display device of claim 18, wherein the first state includes both high and low values, and the second state includes only the high value.

20. The display device of claim 19, wherein the first gate signal is output earlier than the second gate signal.

21. The display device of claim 20, wherein the display device is a liquid crystal display.

* * * * *